US005595640A

United States Patent [19]

von Hoffmann

[11] Patent Number: 5,595,640

[45] Date of Patent: Jan. 21, 1997

[54] METHOD AND APPARATUS FOR CONTINUOUS GALVANIC APPLICATION OF METALLIC LAYERS ON A BODY

[75] Inventor: Timm von Hoffmann, Muehlacker, Germany

[73] Assignee: Metallglanz Gesellschaft fuer Entgratung und Oberflaechentechnik mbH, Muehlacker, Germany

[21] Appl. No.: 520,071

[22] Filed: Aug. 28, 1995

[51] Int. Cl.[6] ..... C25D 2/04; C25D 5/08; C25D 5/34; C25D 17/00

[52] U.S. Cl. ..... 205/205; 205/219; 205/670; 205/671; 205/672; 205/687; 204/206; 204/272; 204/273

[58] Field of Search ..... 205/205, 210, 205/219, 640, 660, 670, 671, 672, 687, 704, 137–142; 204/206–207, 272–273

[56] References Cited

U.S. PATENT DOCUMENTS

| | | | |
|---|---|---|---|
| 2,970,950 | 2/1961 | Bahmann | 204/272 X |
| 3,894,924 | 7/1975 | Toledo | 205/138 X |
| 3,896,010 | 7/1975 | Vetter | 205/138 |
| 3,994,786 | 11/1976 | Marks et al. | 205/138 |
| 4,409,071 | 10/1983 | Dibble | 205/133 |

*Primary Examiner*—Donald R. Valentine

*Attorney, Agent, or Firm*—McAulay Fisher Nissen Goldberg & Kiel, LLP

[57] ABSTRACT

Nozzle body acting as an insoluble anode for the galvanic or chemical treatment of rod-shaped or pipe-shaped objects continuously moved through the nozzle body and acting as cathode. The nozzle body is arranged in a hollow body serving as a pressure vessel, the electrolyte flowing through the hollow body. The hollow body has a plurality of radial bore holes acting as nozzles, these bore holes being arranged in a plurality of cross-sectional regions lying at a distance from one another and being inclined at angles (α) and (β) relative to the longitudinal axis of the nozzle body and relative to the respective cross-sectional region. Diaphragms are associated with the nozzle body which is coated on all sides with a layer of metal from the platinum group. The diaphragms are arranged in the through-opening of the nozzle body, surround the body to be treated, and are situated in planes between the outlet openings of the bore holes. The through-flow openings of the diaphragms are enlarged in cross section in a stepwise manner in the direction opposite to the throughput direction of the body for the purpose of preventing a pressure drop in the nozzle body.

12 Claims, 3 Drawing Sheets

Durchlauf-
richtung
19
20
23
24
30
34
26
15
α
F
E
D
C
B
A
32
46
47
36
14
38
44
35
37
11
31
16
39
III

METHOD AND APPARATUS FOR CONTINUOUS GALVANIC APPLICATION OF METALLIC LAYERS ON A BODY

BACKGROUND OF THE INVENTION

1. Field of the Invention

The present invention is directed to a galvanic process for galvanic or chemical treatment, in particular for the continuous application of metallic layers on a body and to a device for implementing the process.

2. Description of the Related Art

It is known in theory that the deposition rate in electrolytic transfer of material increases in proportion to increasing current densities. In practice, however, a diffusion layer forms at the cathode as current densities increase, since the transfer of matter between the anode and cathode is slower than the deposition rate of the ions in the immediate vicinity of the cathode. Thus the greater the selected current density applied, the greater the diffusion layer around the cathode and the slower and less complete the deposition rate of the ions on the cathode. Beyond a determined reaction speed, the delivery of metal ions at the phase limit between the material transfer region and charge passage region can no longer compensate for the consumption at the cathode. Therefore the current density/deposition rate curve exhibits an asymptotic limiting value which occurs, as mentioned above, due to the electrically insulating diffusion layer resulting from insufficient supply of matter. Electrolyte movement can provide a solution. As experiments have shown, the thickness of the diffusion layer decreases as the intensity of electrolyte movement increases. On the other hand, metallic deposits become rough and powdery when the selected current densities approach the theoretically possible limiting current densities. Therefore, in order to obtain satisfactory coating qualities, it is necessary to select current densities which lie far below the possible limiting current density and which, as a rule, amount to roughly only one third of the limiting current density.

In zinc deposition especially, an increased current density leads to unusable zinc deposits at the body which is to be coated owing to the present diffusion layer and the resulting poor transfer of matter. If a zinc anode is used in addition to the zinc ions in the electrolyte so as to maintain constant the percentage of metal ions for the duration of the galvanizing process, passivity effects occur at the zinc anode, since the anodic current density increases at the anode due to the dissolution process at the anode.

Arranging metal anodes on both sides of the cathode also does not lead to an improvement because this produces eccentric deposits.

DE 34 39 750 A1 discloses a process in which the electrolyte solution is moved in the direction opposite to the movement direction of the body to be coated in order to increase the deposition rate of coating materials to be applied by electrodeposition. The sum velocity resulting at the surface of the body to be coated from the two different speeds lies in the range of turbulent flow.

Although the thickness of the diffusion layer is reduced in this manner by a turbulent flow, the decomposition of the diffusion layer is insufficient. This is demonstrated, for instance, already by the fact that an upper limit of 80 to 90 $A/dm^2$ for the current density to be applied may not be exceeded in this location. Therefore, there continues to be a diffusion layer of 10 to 15 μ at this location on the body to be coated.

OBJECT AND SUMMARY OF THE INVENTION

The primary object of the present invention is to provide a solution to the above problem by means of an improved galvanic process and a device for carrying out the process which enables the diffusion layer between the electrolyte and the body to be coated to be dissolved virtually completely and to shift the asymptotic limiting value of the deposition rate curve upward in order to reduce the coating time substantially and to improve the quality of the metal coating.

In accordance with the method aspect of the invention, this object is met by a galvanic process for galvanic or chemical treatment in particular for the continuous application of metallic layers on a body which is guided in a direction opposite to the flow direction of an electrolyte which flows through a hollow body and is mixed with metal ions. The body is connected to the negative pole of a current source so as to act as a cathode; the hollow body is connected with the positive pole of the current source and acts as an anode. The flow velocity of the electrolyte, which can be influenced by a pump and the movement velocity of the body to be coated are selected so that a turbulent flow occurs at the surface of the body to be coated. The improvement comprises the steps of injecting the electrolyte to be directed on all sides of the circumference of the body so as to be inclined at angles (α, β) relative to and opposite the throughput direction of the body by partially changing the flow velocity of the injected electrolyte with respect to the body for the purpose of completely dissolving the diffusion layer on the entire surface of the body to be coated and regulating the current of the current source such that a current density of 10 to 400 $A/dm^2$ prevails on the surface of the body.

Also in accordance with the invention, a device for carrying out a galvanic process for galvanic or chemical treatment comprises a first hollow body acting as a nozzle body being provided for treatment of a body. The first hollow body is arranged centrally in a second hollow body through which the electrolyte flows. The nozzle body has a plurality of radial bore holes acting as nozzles. The bore holes are arranged in a plurality of cross-sectional regions lying at a distance from one another and being inclined at angles (α) and (β) relative to a longitudinal axis of the nozzle body and relative to the respective cross-sectional region. The diaphragms are associated with the nozzle body, surround the body to be treated and are situated in planes between the outlet openings of the bore holes. The through-flow openings of the diaphragms are enlarged in cross-section in a stepwise manner in the direction opposite to the throughput direction of the body for the purpose of preventing a pressure drop of the nozzle body.

As a result of the virtually complete dissolution of the diffusion layer, the process according to the invention enables an increase in the deposition rate while at the same time improving the coating quality in the selected operating range of the current density/deposition rate curve.

As a result of the inventive construction of the nozzle body acting as insoluble anode and the swirl inclination of the nozzles for the delivery of the electrolytes, the flow strikes the treated body uniformly on all sides regardless of its diameter or surface qualities. By partially modifying the flow along the body in a stepwise manner, not only is a pressure drop prevented in the injected electrolyte with respect to the length of the body to which it is applied, but, further, as regards the galvanizing process, a flow of electrical current is achieved which acts on the body in a pulsatile manner. This is achieved in that the diaphragms act as throttling locations at which the flow rate increases, which results in increased flow with respect to the transfer of matter. As a result of the directed flow against the body which is effected on all sides at high velocity and also as a result of the partial change in the flow rate, the diffusion layer is destroyed virtually completely along the aforementioned surface of the body so as to ensure a trouble-free transfer of matter to the cathode.

Further, the body to be treated is automatically centered in the nozzle body via the flow effect of the diaphragms so as to ensure a uniform geometrical distance of the body from the inner wall of the nozzle body. Uniform layer thickness is achieved and short circuits are prevented in this way. Moreover, it is ensured that the metallic coating applied to the body is not damaged mechanically.

Whereas the processes of the prior art for galvanization, e.g., galvanic zincing, have a maximum current density of 80 to 90 A/dm$^2$ at the surface of a body to be coated, the process according to the invention, e.g., in galvanic zincing, allows a current density of 10 to 400 A/dm$^2$. Thus the deposition rate is roughly three to five times greater compared with the prior art.

The diaphragms in the form of annular disks made of nonmetallic, electrically nonconductive material such as plastic or ceramic make it possible to optimize the pulse width and pulse frequency of the flow of electric current acting on the body to be galvanized by selecting the relative distance between the diaphragms and selecting their inner diameter while taking into account the diameters of the outlet openings of the bore holes, and by selecting their quantity—throughput of electrolytes—as well as their thickness. When electrically conductive material is used for the diaphragms, other electrical fields occur in the electrolyte and accordingly other types of coating are also formed. Similarly, this is true also with an alternating arrangement of diaphragm materials. Accordingly, as experiments have shown, metal alloys and predetermined textural structures can be electrodeposited, which was not possible previously.

Depending on the desired production time and quality of the metallic layer or its thickness, it is possible to arrange an optional number of devices according to the invention one after the other in series.

DE 33 17 970 A1 describes a process for local electroplating of a printed circuit board by means of electrolytes exiting from two oppositely located nozzles (see page 7, lines 11 to 13, of reference). The printed circuit board is moved past the nozzles in a manner similar to flow soldering in order to achieve a sheet-like coating, the electrolyte being fed to the nozzles from a tub and applied via the nozzles for this purpose. Thus the nozzles serve exclusively to achieve the desired partial coating of the printed circuit boards and not to increase the output velocity of the electrolyte. Therefore the problem of dissolving a diffusion layer by means of a final velocity of the electrolytes from the sum of the velocity vectors for the purpose of generating a turbulent flow is not addressed and accordingly not indicated in this reference.

The invention is described in the following with reference to an embodiment example shown in the drawings.

DESCRIPTION OF THE PREFERRED EMBODIMENTS

Figure 1:
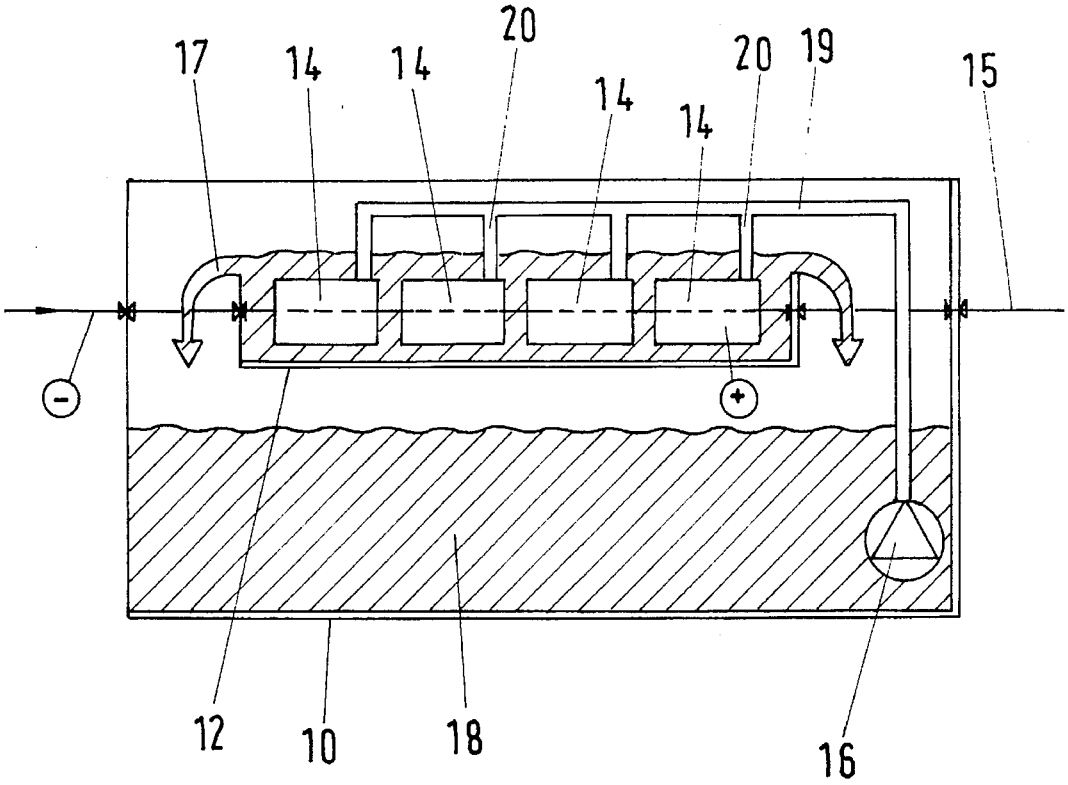
FIG. 1 shows an arrangement for galvanization with a device according to the invention.

FIG. 1 shows a work vessel 12 which is located in a process vat 10 and which receives devices 14, to be described in the following, for galvanization or chemical treatment, according to the embodiment example, for continuous application of a metallic layer on a body 15 which is continuously guided through the work vessel 12 and devices 14, the body 15 being constructed in the shape of a rod in the present case.

An electrolyte 18 located in the process vat 10 is fed via a pump 16 to the individual device 14 via a pump line 19 and a feed 20 in the form of pipe connections. The exiting electrolyte flows back into the process vat 10 in the direction of arrow 17. The flow rate of the electrolyte can be influenced by the pump.

Figures 2, 4:
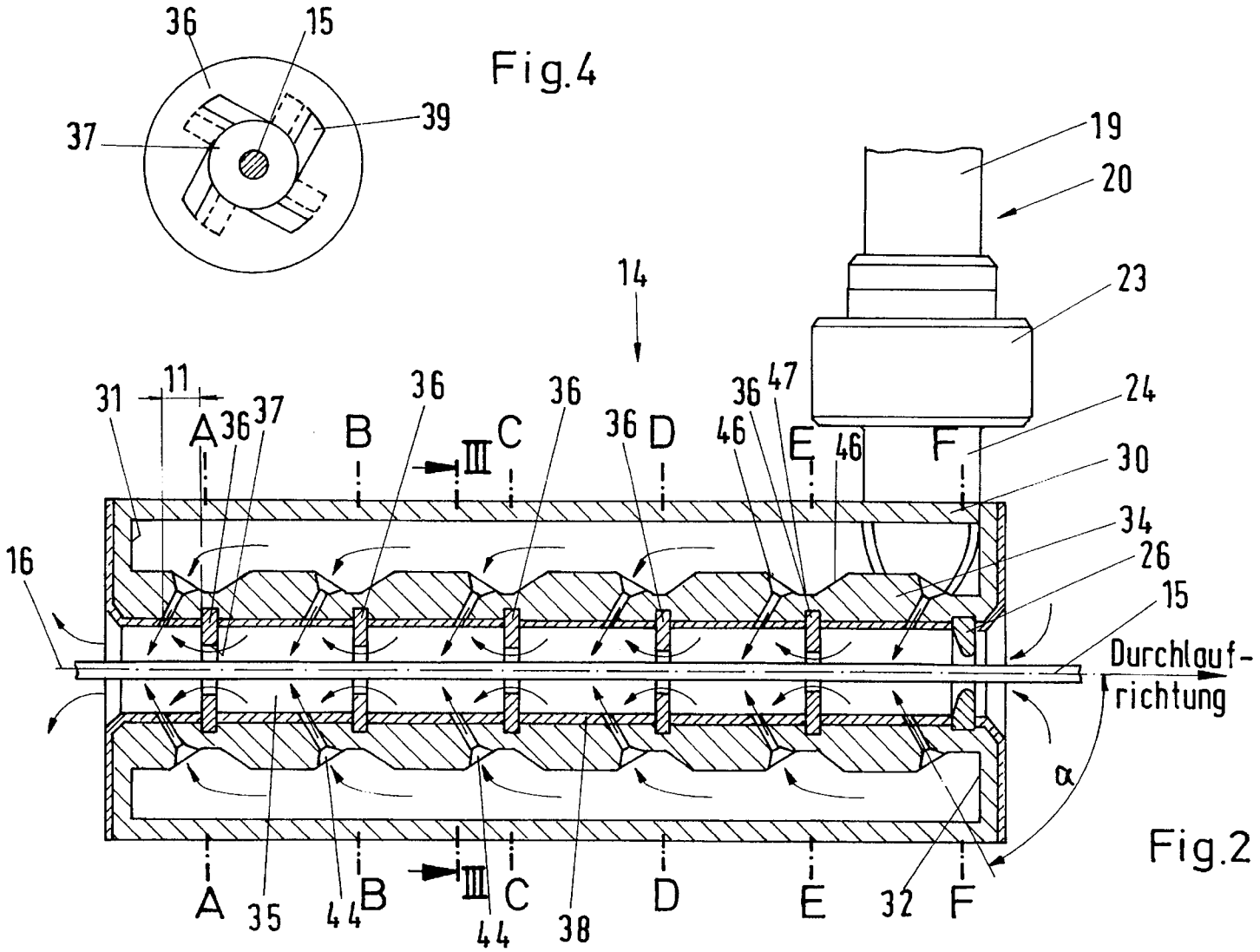
FIG. 2 shows a longitudinal section through an embodiment example of a device for carrying out the process according to the invention with a nozzle body having a central through-bore hole and a plurality of nozzle bore holes in the region planes orthogonal to the central bore hole, which nozzle body encloses a body to be coated, and with a hollow body serving for the feed of the electrolyte.
FIG. 4 is an enlarged view of a detail from FIG. 2.

One of the devices 14 is shown in an enlarged view in FIG. 2. As will be seen from the drawing, the electrolyte 18 which is introduced via the feed 20 flows through the device 14 and passes, via a hollow body 30, into a nozzle body 34 in a manner to be described in the following. As is indicated by the individual arrows, the electrolyte flows from the nozzle body 34 back into the work vessel 12 and then into the process vat 10.

Figure 3:
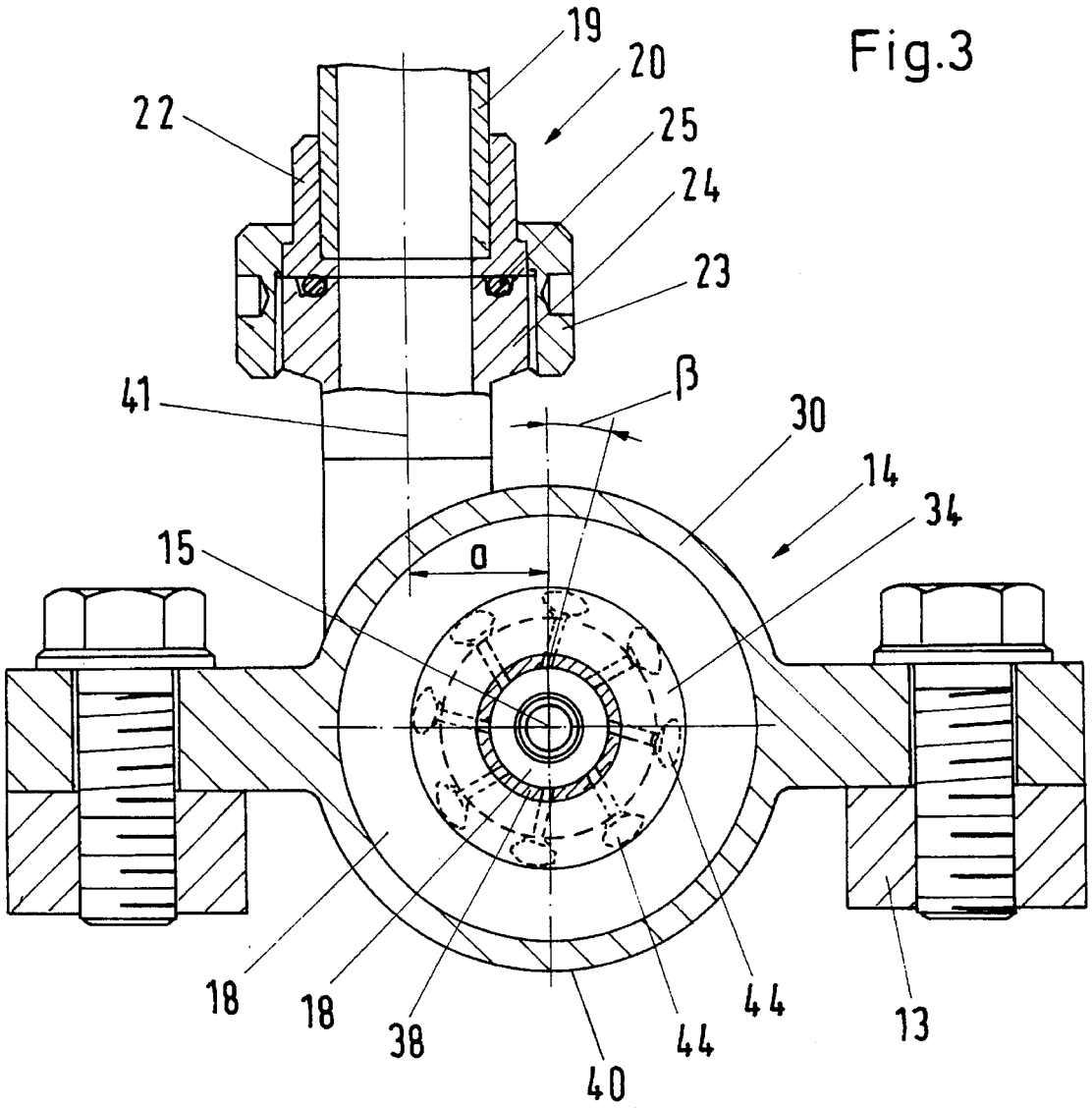
FIG. 3 shows a front view of the device according to FIG. 2.

As will be seen from FIGS. 2 and 3, the device, designated in its entirety by 14, for continuous galvanizing of wires, outer surfaces of pipes or the like bodies 15 comprises the hollow body 30 through which the electrolyte 18 flows, this hollow body 30 forming a pressure vessel and having two end sides 31 and 32, and the nozzle body 34 which is constructed as a hollow body and is arranged coaxially to the hollow body 30. The nozzle body 34 and the hollow body 30 have a common central through-opening 35. The nozzle body 34 is coated on all sides by an insoluble metallic layer 38 of a metal from the platinum group. This metallic layer 38 also covers the end sides 31 and 32 and the inner surface area of the hollow body 30 and has a thickness of 2 to 20 μ. For the sake of clarity, FIG. 2 shows only the through-bore hole 35 with the metallic layer 38. In this way, it is ensured that the effective surfaces of the nozzle body 34 will not impart metal ions to the electrolyte 18.

The feed 20 is connected with the surface area of the hollow body 30 and is constructed as a pipe connection 24 which opens out tangentially—see FIG. 3—and which is connected with a flange 22 of the pump line 19 via a union nut 23. An O-ring seal 25 is arranged between the flange 22 and the pipe connection 24. Thus the pump line 19 is connected with the pipe connection 24 so as to be detachable but also in a sealing manner.

The nozzle body 34 has a plurality of bore holes 44 distributed uniformly along its entire circumference. These bore holes 44 are arranged so as to be distributed at equal distances with reference to cross-sectional regions 11 extending vertically to the longitudinal axis 16 and extend so as to be inclined at identical angles α and at a swirl angle β—see FIGS. 3 and 4—relative to the body 15 to be coated and opposite to the throughput direction of this body 15 which is guided centrally through the nozzle body 34. An electrically nonconductive guide ring 26 is arranged at the outlet side 25 of the nozzle body 34.

As is shown in FIG. 3, the axis of symmetry 41 of the pipe connection 20 is offset parallel to and eccentrically at a distance (a) relative to the transverse axis 40 of the device 14. As a result, the electrolyte 18 which is pumped into the hollow body 30 enters the hollow body 30 in such a way that its flow behavior remains unperturbed as far as possible and flows around the nozzle body 34. The inlet openings of the bore holes 44 are situated on flanks 46 of the outer surface area of the nozzle body 34 which form part of constricted portions 47 which are situated uniformly one alter the other and are V-shaped in cross section. The pumped in electrolyte 18 flows into these constricted portions 47 and subsequently, without loss of pressure, into the bore holes 44 and, via the outlet openings 37 acting as laval nozzles, into the space of the through-opening 35. Diaphragms 36, each of which has a through-opening 37, are inserted into the through-opening 35 of the nozzle body 34 so as to be offset in the longitudinal direction relative to the cross-sectional regions 11 in planes A to E which intersect the longitudinal axis 16 at right angles.

One of the diaphragms 36 formed from electrically nonconductive material is shown in FIG. 4. For certain applications, these diaphragms 36 can also be formed from an electrically conductive material or can be arranged alternately as electrically conductive and electrically nonconductive materials. The through-flow opening 37 of the diaphragms 36 is enlarged in cross section in a stepwise manner with reference to the through-flow direction of the electrolyte which is directed opposite to the throughput direction of the body 15 to be coated so as to prevent a pressure drop in the nozzle body 34. Thus the smallest through-flow opening 37 is located in plane E, while the largest through-flow opening 37 is located in plane A. As is shown in FIG. 4, the diaphragms 36 have a plurality of swirl-producing notches 39 aligned tangentially to the through-opening 37.

The described device operates in the following manner: The body 15 to be coated is connected to the negative pole of a current source, not shown, e.g., via current-carrying contact rollers, while the nozzle body 34 is connected via current rails 13 with the positive pole of the current source, not shown. The current density is regulated to 10 to 400 $A/dm^2$, corresponding to the process to be carried out, via circuit elements, known per se.

The inherent velocity impressed on the body 15 to be coated acts in the throughput direction. The electrolyte 18 which is under pressure between the hollow body 30 and nozzle body 34 passes through the bore holes 44 of the nozzle body 34.

The electrolyte 18 delivered via the pump 16 is accelerated as it flows through the bore holes 44, since these bore holes 44 act as laval nozzles, and is injected so as to be inclined at an angle α to—and opposite the throughput direction of—the body 15 to be coated, as well as at a swirl angle β. As a result of the uniform arrangement of the bore holes 44 in the nozzle body 34, the electrolyte 18 uniformly strikes the entire surface of the body 15 to be coated which is moving opposite to the flow direction.

In so doing, the oppositely directed movement vectors of the body 15 are added to those of the injected electrolyte 18 and, by means of the jet action of the bore holes 44 at the surface of the body 15 to be coated, cause a turbulent flow acting along the entire surface. The diffusion layer occurring during galvanization is practically completely destroyed by this turbulent flow.

The pressure of the electrolyte 18 in the nozzle body 34 is maintained constant along its entire length by means of the diaphragms 36 with their stepped through-openings 37, which diaphragms 36 are arranged between the respective region planes 11 of the bore holes 44. At the same time, these diaphragms act as locally defined shoots for the electrolyte 18, so that, with respect to the galvanizing process, a current flow is generated which acts on the body 15 in a pulsed manner.

As a result of these steps, current densities of 10 to 400 $A/dm^2$ can be selected between the electrolyte 18 and the surface of the body 15 to be coated in the present example of galvanic zincing. In this way, the galvanic coating process is accelerated in comparison to the previously known processes and substantially thicker layers can be applied per unit of time than was previously possible.

The purpose of the guide ring 26 is to prevent a short circuit between the body 15 and nozzle body 34. Such a short circuit would come about if the body 15 were to contact the nozzle body 34 owing to the relative movement between the body 15 and electrolyte 18 and the resulting oscillations.

Of course, it is possible to use a smaller or greater number of region planes 11 than was described in this embodiment example depending on quality requirements, materials used or type of alloy.

While the foregoing description and drawings represent the preferred embodiments of the present invention, it will be obvious to those skilled in the art that various changes and modifications may be made therein without departing from the true spirit and scope of the present invention.

What is claimed is:

1. In a galvanic process for galvanic or chemical treatment, in particular for the continuous application of metallic layers on a body which is guided in a direction opposite to the flow direction of an electrolyte which flows through a hollow body and is mixed with metal ions, said body being connected to the negative pole of a current source so as to act as a cathode, while the hollow body is connected with the positive pole of the current source and acts as an anode, wherein the flow velocity of the electrolyte, which can be influenced by a pump, and the movement velocity of the body to be coated are selected so that a turbulent flow occurs at the surface of the body to be coated, the improvement comprising the steps of:

injecting the electrolyte to be directed on all sides of the circumference of the body so as to be inclined at angles (α, β) relative to and opposite the throughput direction of the body by partially changing the flow velocity of the injected electrolyte with respect to the body for the purpose of completely dissolving the diffusion layer on the entire surface of the body to be coated; and regulating the current of the current source such that a current density of 10 to 400 $A/dm^2$ prevails on the surface of the body.

2. The process according to claim 1, including the step of eliminating the pressure drop with respect to the length of the body acted upon by a stepwise partial change in the flow of electrolyte along the body to be treated and generating a cathodic flow of current acting in a pulsatile manner by a zone-by-zone partial reduction of the cathodic current density with respect to the length of the body which is acted upon.

3. The process according to claim 2, wherein a pipe connection serving for the feed of the electrolyte is offset axially with its longitudinal axis at a distance relative to the transverse axis of the device.

4. The process according to claim 2, wherein the hollow body enclosing the nozzle body is arranged in a work vessel through which the electrolyte flows.

5. A device for carrying out galvanic or chemical treatment comprising:

a first hollow body acting as a nozzle body being provided for treatment of a body;

said first hollow body being arranged centrally in a second hollow body through which an electrolyte may flow;

said nozzle body having a plurality of radial bore holes acting as nozzles;

said bore holes being arranged in a plurality of cross-sectional regions lying at a distance from one another and inclined at angles ($\alpha$) and ($\beta$) relative to a longitudinal axis of the nozzle body and relative to a transverse axis of the nozzle body;

diaphragms being associated with said nozzle body; and, current source means for providing a current density of 10 to 400 A/dm$^2$ at a surface of the body to be treated;

wherein said diaphragms; (i) are arranged in a through-opening of the nozzle body, (ii) surround the body to be treated, (iii) are situated in planes between outlet openings of the bore holes and, (iv) include through-hole openings which are enlarged in cross section in a stepwise manner in the direction opposite to the throughput direction of the body for the purpose of preventing a pressure drop in the nozzle body.

6. The device according to claim 5, wherein all sides of the nozzle body and the inner surface area of the hollow body with the end sides are coated with an insoluble metallic layer of a metal from the platinum group, the thickness of the layer being 2 to 20 $\mu$.

7. The device according to claim 6, wherein a guide ring of electrically nonconductive material is arranged at an outlet opening of the nozzle body through which the body to be coated leaves the nozzle body.

8. The device according to claim 5, wherein the diaphragms are formed from electrically nonconductive material.

9. The device according to claim 5, wherein the diaphragms are formed from an electrically conductive material.

10. The device according to claim 5, wherein the diaphragms are formed from electrically conductive material and electrically nonconductive material and are arranged in an alternating manner.

11. The device according to claim 5, wherein the diaphragms have notches which generate a swirl and are aligned tangentially with respect to the through-flow opening.

12. The device according to claim 5, wherein an optional number of hollow bodies are arranged in series one after the other in a work vessel.

* * * * *